US005384915A

United States Patent [19]

Rodriguez

[11] Patent Number: 5,384,915

[45] Date of Patent: Jan. 31, 1995

[54] EXPANDABLE OUTERWEAR GARMENT

[76] Inventor: Kay A. Rodriguez, 2007 Paradise Rd., Las Vegas, Nev. 89104

[21] Appl. No.: 65,602

[22] Filed: May 21, 1993

[51] Int. Cl.[6] ..... A41D 1/00

[52] U.S. Cl. ..... 2/93; 2/85; 2/108; 2/97

[58] Field of Search ..... 2/93, 85, 108, 97, 94, 2/DIG. 2

[56] References Cited

U.S. PATENT DOCUMENTS

| | | | |
|---|---|---|---|
| 2,412,988 | 12/1946 | Kleinman | 2/DIG. 2 |
| 2,582,772 | 1/1952 | Egbert | 2/97 |
| 2,636,176 | 4/1953 | Ross | 2/93 |
| 2,711,539 | 6/1955 | Losher | 2/97 |
| 3,523,302 | 8/1970 | Rabedeaux . | |
| 4,103,361 | 8/1978 | Carmen | 2/97 |
| 4,320,538 | 3/1982 | Saft . | |
| 4,535,479 | 8/1985 | Paula . | |
| 4,768,233 | 9/1988 | Grilliot et al. | 2/97 |
| 4,773,102 | 9/1988 | Curtis et al. . | |
| 4,864,656 | 9/1989 | Nesse | 2/97 |
| 5,040,243 | 8/1991 | Tatsuno | 2/94 |
| 5,077,838 | 1/1992 | Senser . | |
| 5,201,075 | 4/1993 | Svetich | 2/108 |

*Primary Examiner*—Clifford D. Crowder

*Assistant Examiner*—Gloria Hale

*Attorney, Agent, or Firm*—John C. Lambertsen

[57] ABSTRACT

An outer garment to be worn by one or more people together, having an outer jacket with a pair of sleeves, and an inner jacket portion with one sleeve. The outer jacket and inner jacket are partially connected at the neck opening and partially connected at the waistband. The garment is convertible from an unexpanded configuration wearable by one person to an expanded configuration wearable by at least two people. In the unexpanded configuration, the one sleeve of the inner jacket portion is inserted by the wearer into one of the sleeves of the outer jacket. To change to the expanded configuration, a securing feature on the back of the outer garment is released allowing additional folded material to be unfolded into an expanded back portion. In addition, in another embodiment, when an inner panel is attached to the back portion of the outer jacket, two people can both be separately enveloped in their own garment. The expandable feature allows for ease of movement by the people wearing the garment. When worn by two caring people, they can enjoy close physical contact and embrace each other while wearing the garment. The garment is designed for warmth and is also adaptable to different-sized people.

3 Claims, 3 Drawing Sheets

EXPANDABLE OUTERWEAR GARMENT

FIELD OF THE INVENTION

The field of technology of this invention is articles of clothing, specifically relating to an outer garment for an individual that can be converted into an outer garment that is large enough to be worn by more than one person simultaneously.

BACKGROUND

This invention relates to novel improvements in a jacket-type garment for wear over other clothing, particularly, but not by way of limitation, for two people who care for each other to wear the garment simultaneously.

The field of outer garments is crowded, yet relatively few garments are designed for wear by two or more people. Some of the more relevant garments in the prior art follow.

RABEDEAUX U.S. Pat. No. 3,523,302, Aug. 11, 1970, describes a full-length outdoor coverall garment to be worn by one or more persons for protection from the elements.

SAFT U.S. Pat. No. 4,320,538, Mar. 23, 1982, describes an uninsulated vest, with insulated arms, to be worn by one person, the vest being worn underneath a sleeveless insulated jacket.

PAULA U.S. Pat. No. 4,535,479, Aug. 20, 1985, describes an outer garment, with two separate neck openings, to be worn by two persons simultaneously.

CURTIS, et al. U.S. Pat. No. 4,773,102, Sep. 27, 1988, describes an outer garment, with a vest, two sleeves, and two inner arm support compartments, to be worn by two persons at the same time.

SENSER U.S. Pat. No. 5,077,838, Jan. 7, 1992, describes an outer garment, with a sleeveless vest, removable sleeves, numerous pouches, and other convertible features, to be worn by one person.

Each of the above-mentioned patents provided certain desirable features as an outer garment. However, each also has disadvantages or problems to be solved. RABEDEAUX is designed to be a full-length garment providing limited mobility. SAFT is designed for only one person and also requires multiple separate parts for full advantage of the disclosed embodiment. PAULA is designed, as disclosed, to be relatively lightweight and therefore not providing warmth for colder weather. CURTIS does provide a garment for warmth, and for two persons; however, there is no teaching of an expandable feature to accommodate different sized people. Nor can this garment be worn by one person if desired. SENSER discloses several desirable features, yet is designed for only one person.

Therefore, it is clear that none of the cited prior art fills the need for an outer garment that can be worn by one or more people, provides warmth, provides mobility of the wearers, and also has an expandable feature for different sized people.

SUMMARY OF THE INVENTION

The above disadvantages and problems, plus others, are overcome by the present invention. Briefly stated, the present invention provides novel improvements to garments, in the form of an expandable outerwear garment.

In a preferred embodiment, the garment includes an outer jacket and an inner jacket portion. The outer jacket has an outer front portion, an outer back portion, and a pair of sleeves. The inner jacket portion has an inner front portion, an inner back portion, and an inner sleeve.

The outer jacket and inner jacket portion are connected to each other in two places. The outer jacket neckband is connected to part of the inner neckband. In addition, the outer jacket waistband is connected to part of the inner waistband. The ability to have one garment to keep track of, instead of several different parts, is just one of several advantages of the present invention.

The expandable garment is convertible from an unexpanded configuration to an expanded configuration. This expandable feature is a decided and novel advantage. One person can wear the garment in the unexpanded configuration, while two or more can use the garment when expanded. In addition, the people wearing the expandable garment can be of different physical sizes. For instance, different family members can certainly enjoy wearing this garment. When expanded, the present preferred embodiment provides sufficient additional material to allow for freedom of movement by the wearers. Not only can they enjoy close physical contact, but are able to embrace each other because the additional material allows flexibility of movement.

To convert to the expanded configuration, a securing feature on the back of the garment is released allowing additional folded material to be unfolded into an expanded back portion.

When used in the unexpanded configuration, the wearer can first insert an arm into the one inner sleeve of the inner jacket portion. Then the wearer inserts the same arm through one of the two sleeves in the outer jacket. The wearer's second arm is then inserted into the remaining sleeve of the outer jacket. Alternatively, the wearer can first put one arm into one sleeve of the outer jacket, and then insert the other arm into the inner sleeve, and the remaining outer sleeve in sequential order.

In the expanded configuration, a first person can have one arm through one outer jacket sleeve and the other arm through the inner sleeve. A second person can have one arm through the second outer jacket sleeve and the other around the back of the first person.

In another preferred embodiment, the outer jacket includes an inner panel. The inner panel is attached to the back portion of the outer jacket in approximately the center of the back portion. The inner panel is generally shaped as a half vest and is of a size as permits its securement to the edge of the right front portion of the outer jacket. In this embodiment, two people can both be separately enveloped in their own garment. With the inner panel feature, a second person is protected even more from weather elements because the inner panel surrounds the upper torso.

Problems and disadvantages of the cited prior art that are overcome by this invention include: 1) an inability to provide a garment wearable by one person or more than one; 2) an inability to provide a garment adaptable to different sized people; 3) having to keep track of multiple parts to an outer garment; 4) limited mobility and limited freedom of movement by the wearers; and 5) insufficient warmth for the wearers in relatively cold weather.

In summary, the advantages of the present invention include: 1) providing an outerwear garment wearable by one person, or expandable to fit more than one; 2) a garment adaptable to different sized people; 3) having only a single garment to meet the wearers' needs; 4) much freedom of movement by the wearers; 5) sufficient warmth for cold weather; and 6) ease of storage because of the foldable feature into effectively one jacket from the expanded configuration.

These, and other, features and advantages of the present invention are set forth more completely in the accompanying drawings and the following description.

BRIEF DESCRIPTION OF THE DRAWINGS

Details of the invention, and of the preferred embodiments thereof, will be further understood upon reference to the drawings, wherein.

DETAILED DESCRIPTION OF THE PREFERRED EMBODIMENTS

Figure 1:
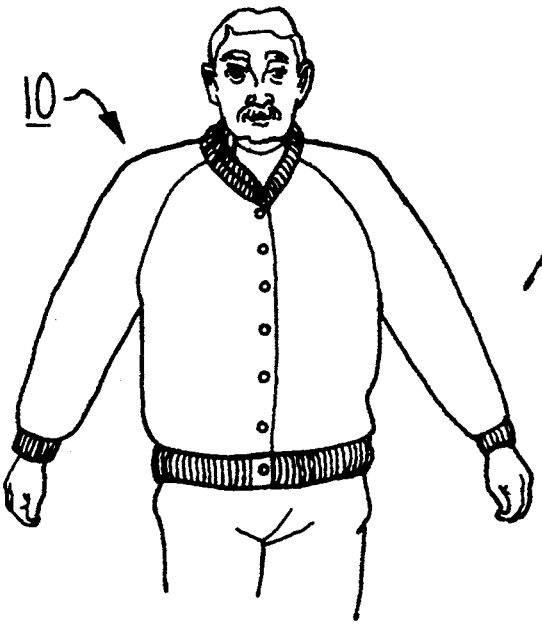
FIG. 1 is a perspective view of the expandable outerwear garment shown as worn by one person in an unexpanded embodiment.
Figure 3:
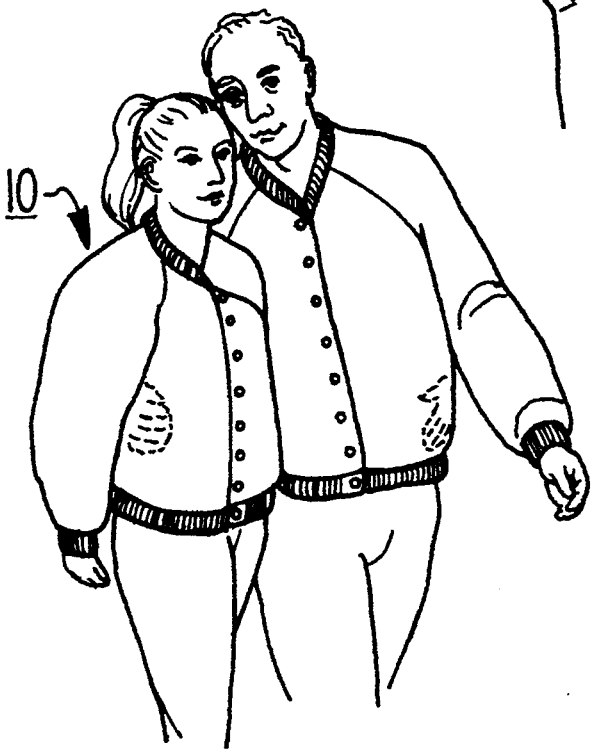
FIG. 3 is a front perspective view of another preferred embodiment of the expandable garment as worn by two people.
Figure 4:
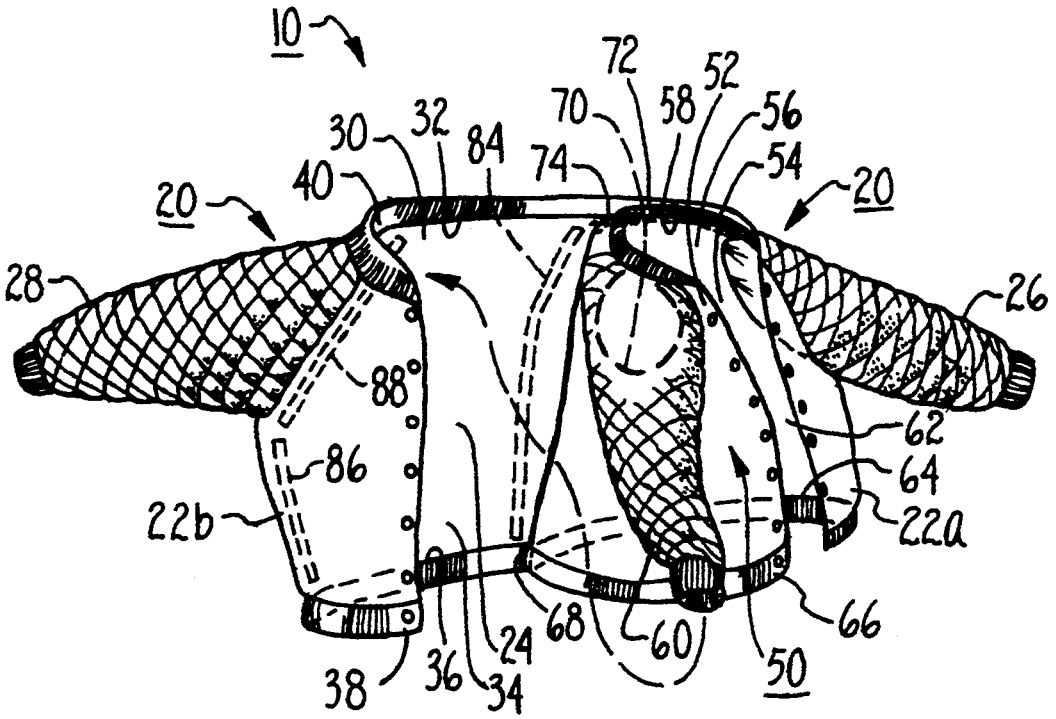
FIG. 4 is a detail front perspective view with portions shown in phantom, showing the expanded embodiment an open configuration, specifically illustrating the three sleeves.

Referring initially to FIG. 1, there is seen the present invention in a preferred embodiment. Illustrated is one person wearing the expandable outerwear garment 10 in an unexpanded configuration. Note that the outward appearance seems to reveal an ordinary jacket seen and worn virtually every day. What is not seen (in FIG. 1) is the additional fabric material that permits the outerwear garment 10 to be expanded. Therefore, clearly shown is one of several advantages of the present invention, that of providing an outerwear garment wearable by one person, yet still expandable to fit more than one. A detailed description of the additional fabric material and the expandable feature follows (FIGS. 2–4).

Note that the expandable outerwear garment 10 is shown in a closed position. The method of closing the garment 10 is illustrated as snaps or buttons. However, other well-known techniques can also be used, such as a zipper.

Figure 2:
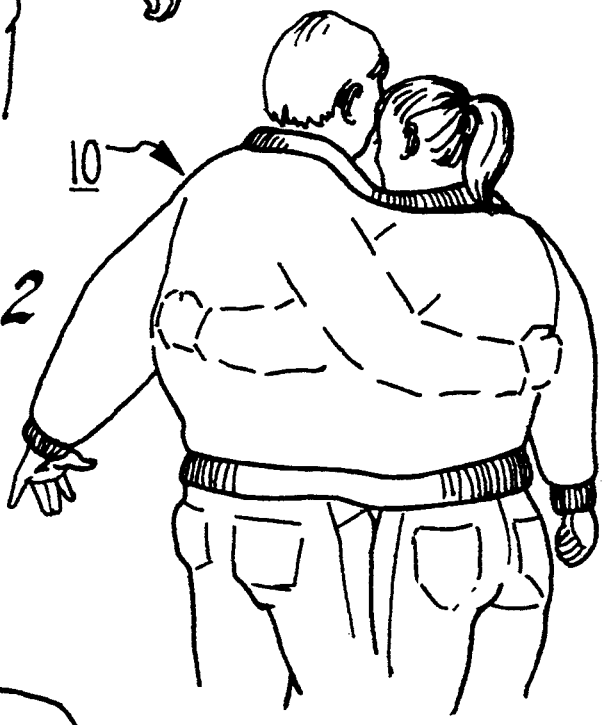
FIG. 2 is a perspective view of the expandable garment shown as worn by two people in a preferred expanded embodiment.

Referring next to FIG. 2, there is seen the present invention in another preferred embodiment. Illustrated here are two people wearing the expandable outerwear garment 10 in an expanded configuration. The illustrated rear view, showing the backs of the two people clearly reveals an expanded garment made possible by the additional fabric material previously discussed. Note one of the other advantages of the present invention. In this preferred embodiment, two people who care for each other are wearing the garment simultaneously. Furthermore, it is observed from FIG. 2 that, in this embodiment, different-sized people and different heights are accommodated. In addition, much freedom of movement is possible as evidenced by the couple embracing each other with concealed arms.

Finally, comparing FIG. 2 with FIG. 1, it is seen that storage of the garment is not a problem. Many outer garments are quite bulky and lengthy, thereby taking up a great deal of room in a closet when hung on a hanger. Some outerwear garments are so large that they do not even fit on a typical hanger, but must be hung on a coatrack. However, in the present invention, the additional material seen in the expanded configuration of FIG. 2 is effectively folded into a garment, creating the garment depicted in FIG. 1. In the unexpanded configuration, the garment can easily hang in a closet.

Referring now to FIG. 3, there is seen another preferred embodiment of the expandable garment 10, again with two people wearing the garment 10 in the expanded configuration. Both people are effectively enclosed within their own jacket. This embodiment is further described in FIG. 6.

Referring now to FIG. 4, in one preferred embodiment, there is a front view of the expandable outerwear garment 10 in the expanded configuration. It is also clearly seen in FIG. 4 that two people do not have to be of the same physical size to wear the illustrated garment 10. Two identically sized people can wear the garment 10, or two different sized people can wear it. In some cases, even a child and an adult of different heights can wear the same garment 10. Actually, more than two people can snuggle into the appropriately sized garment 10, even if this results in one or more of them is not using the sleeves.

As seen in FIG. 4, expandable garment 10 includes an outer jacket 20 with a bodice having both an outer front portion 22 and an outer back portion 24, with an outer left sleeve 26 and an outer right sleeve 28 connected to the outer front portion 22. The technique for connecting the outer left sleeve 26 and the outer right sleeve 28 to the respective left and right outer front portions **22*a*, 22*b*** is one of several well-known techniques, such as stitching. One or both sleeves may be removably attached to the outer jacket (not shown) using known fasteners such as buttons, zippers or VELCRO®, VELCRO® brand hook and loop fasteners tape.

In addition to the previously mentioned elements of outer jacket 20, the inside surface of the outer jacket 20 includes and an outer upper lining portion 30 and an outer lower portion 34. Furthermore, an outer waistband 38 is integral to the lower portion 34, while an outer neckband 40 is integral to the upper lining portion 30. That is to say, the waistband 38 and the outer neckband 40 are attached in one of several well-known techniques to the lower portion 34 and the upper lining portion 30, respectively, of the jacket 20.

The expandable garment 10 has at least one novel feature in the incorporation of an inner jacket portion 50. The inner jacket portion 50 has an inner front portion 52 and an inner back lining portion 54. An inner sleeve 60 is connected to an inner arm hole 70 that is part of the inner front portion 52. Here again, as with the outer left sleeve 26 and outer right sleeve 28, the inner sleeve 60 is connected using one of several well-known techniques. The inner sleeve 60 is a novel feature because not only does it allow a person to have both arms covered providing extra warmth, but the same inner sleeve 60 can be comfortably inserted into, in this case, the right, outer sleeve 28 if the garment 10 is being worn by a single person. Obviously the design of the garment 10 can have the inner sleeve 60 either as a right sleeve or a left sleeve, as an alternative embodiment (not shown).

In addition to the previously mentioned elements of the inner jacket portion 50, there is an inner upper portion 56 and an inner lower portion 62 to the inner lining of the jacket 50. Furthermore, an inner waistband 66 is integral to the lower portion 62, while an inner neckband 72 is integral to the upper portion 56. As was the case with the outer waistband 38 and the outer neckband 40, the inner waistband 66 and the inner neckband 72 are attached in one of several well-known techniques to the lower portion 62 and the upper portion 56 of the inner jacket 50, such as stitching.

The outer jacket 20 and the inner jacket portion 50 are preferably connected together in two places, (1) where the outer neckband 40 is attached to part of the inner neckband 72, and in the preferred embodiment, the connecting means is a neckband connecting seam 74, and (2) at the waist area. The neckband connecting seam 74 secures a portion of an outer upper edge 32 of the outer upper portion 30 of the outer jacket 20 to a portion of an inner upper edge 58 of the inner upper portion 56 of the inner jacket portion 50. In a preferred embodiment, the outer waistband 38 is connected to the inner waistband 66 by a waistband connecting seam 68, which secures a portion of an outer bottom edge 36 of the outer lower portion 34 of the outer jacket 20 to a portion of an inner bottom edge 64 of the inner lower portion 62 of the inner jacket portion 50.

This "connected" feature provides another advantage to the present invention. No longer does a person have to keep track of several different parts of an outerwear garment; just one.

If a person wants to wear the expandable garment 10 in the unexpanded configuration, the inner sleeve 60 of the inner jacket portion 50 is placed within the right sleeve 28. Then the wearer inserts an arm through one of the two sleeves, either the left sleeve 26, or the right sleeve 28 (and the inner sleeve 60), in the outer jacket 20. The wearer's second arm is then inserted into the remaining sleeve of the outer jacket 20.

However, in the expanded configuration, a first person has one arm inserted into one outer jacket sleeve, such as the outer left sleeve 26. Then the other arm, in this example the right arm, is inserted into the inner sleeve 60. A second person then inserts that person's right arm through the outer right sleeve 28 and the other arm may then be placed around the back of the first person.

FIG. 4 illustrates a fabric of quilted texture and construction. One of the options available is to have an insulated garment fabricated in a quilted fashion to contain desired insulation materials. Therefore, depending on the weather environment in a particular geographic region, the present invention is adaptable to provide differing insulation requirements for sufficient warmth.

Figure 5:
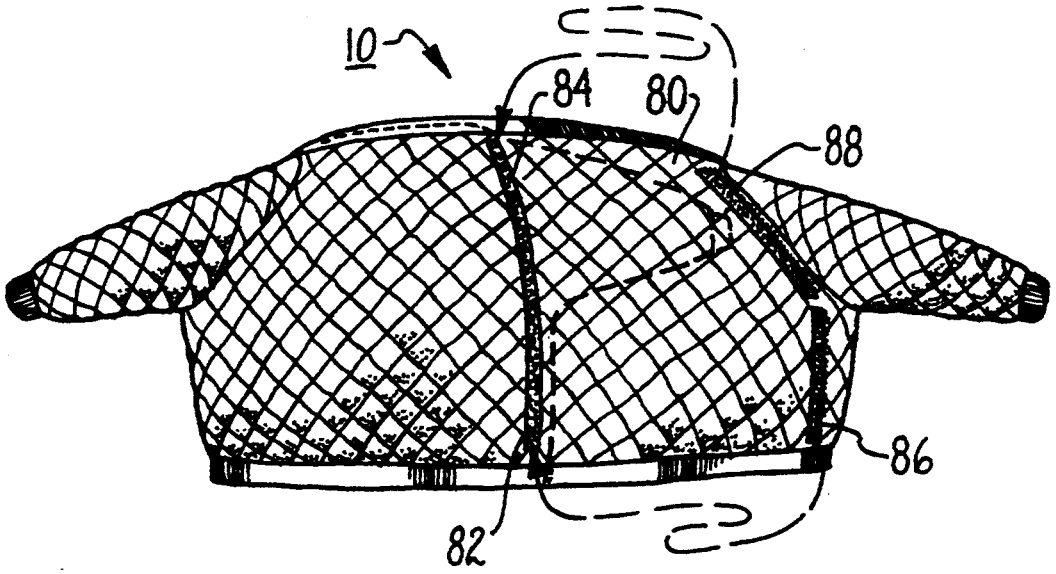
FIG. 5 is a detail back perspective view, with portions shown in phantom, showing the expanded embodiment in an open configuration, with additional material and a securing feature allowing conversion from a garment wearable by one person to an expanded garment wearable by two or more people.

Referring now to FIG. 5, the expandable outerwear garment 10 in the expanded configuration is shown as seen from the back. The additional fabric material that permits the garment 10 to be expanded, as mentioned previously in the description of FIG. 1, is designated in FIG. 5 as the expanded back portion 80. The expanded back portion 80 is securable to the outer back portion 24 of outer jacket 20 by one of several suitable securing methods. In one preferred embodiment, loop and pile fastener members, commonly marketed under the VELCRO® trademark, are used to secure the expanded back portion 80 in a folded fashion to the outer back portion 24. As illustrated in FIG. 5, a lower pile member 82 and an upper pile member 84 are located at a first fastener location 85 and are approximately in the center of the outer back portion 24. A first loop member 86 and a second loop member 88 are located at a second fastener location 89 and are placed on approximately the right edge seam of the outer back portion 24. Although not described in FIG. 4, the loop and pile members 82, 84, 86, 88 are shown in phantom in Fiq. 4. Referring back to FIG. 5, the lower pile member 82 and upper pile member 84 can alternatively be separate members, in similar fashion as shown for the first 86 and the second loop member 88.

Typically, the expandable garment 10 will initially be in an unexpanded configuration. To convert to an expanded configuration, the first loop member 86 and the second member 88 are separated from the lower pile member 82 and the upper pile member 84. As is known to the fastener art, minimal force is needed to pull on the outer back portion 24 of outer jacket 20 to cause the loop and pile members to separate. After the expanded back portion 80 is unfolded, there is sufficient fabric in the outer back portion 24 for the expandable garment 10 to be worn by two or more people.

The orientation of the loop and pile members on the expanded back portion 80 can vary. In one preferred embodiment, the lower pile member 82 is secured in a vertically oriented position on the expanded back portion 80. The upper pile member 84 is also secured in a suitable manner in a vertically oriented position on the expanded back portion 80. The first loop member 86 is also secured in a vertically oriented position on approximately the right edge of the expanded back portion 80. Finally, the second loop member 88 is secured in a diagonally oriented position on the expanded back portion 80.

In another preferred embodiment, zippers and snaps are used to secure the expanded back portion 80 in a folded fashion to the outer back portion 24. In place of loop and pile members, zipper parts are attached in an appropriate fashion to the outer back portion 24. Snaps are also attached at either end of each zipper part, as well as between zipper parts to help secure the expanded back portion 80. To convert to an expanded configuration in this preferred embodiment, the zippers are unzipped by hand, and the snaps are unsnapped with minimal effort required.

Figure 6:
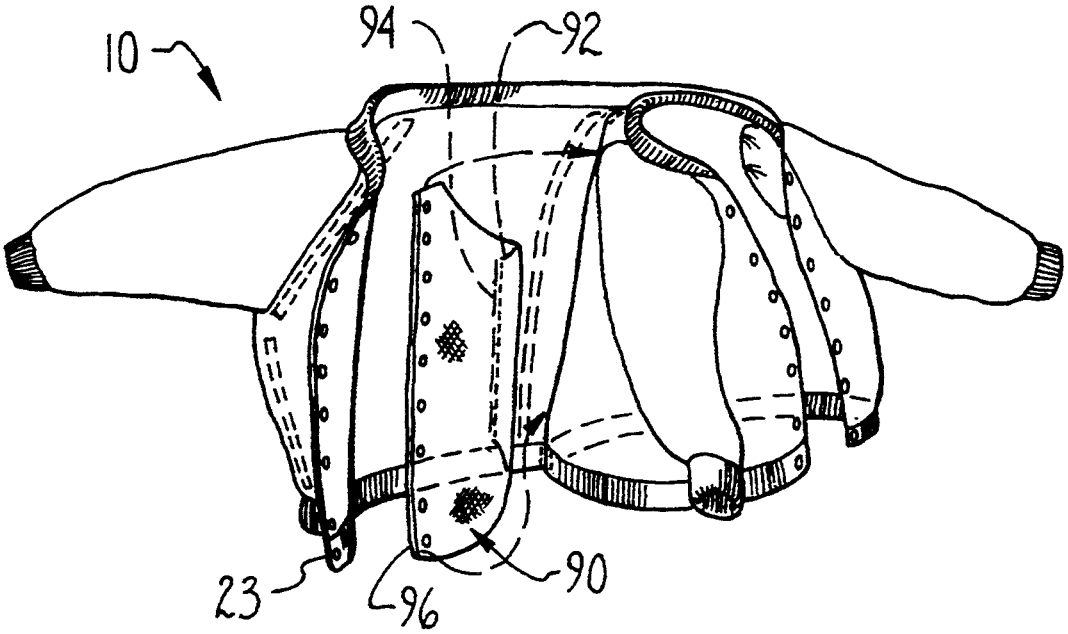
FIG. 6 is a detail front perspective view, with portions shown in phantom, showing another preferred embodiment having an inner panel suitable for enclosing a second person in the expandable garment.

Referring now to FIG. 6, there is seen another preferred embodiment, first mentioned in describing FIG. 3. In FIG. 6 is more clearly shown an inner panel 90 secured to the outer back portion 24 of outer jacket 20. Preferably, the inner panel 90 is sewn into the outer back portion 24 using a vertical seam. The inner panel 90 is sewn in approximately the center of the outer back portion 24 from a position just above the outer waistband 38 to a position approximately level with the outer right sleeve 28.

As shown in FIG. 6, the inner panel 90 is generally shaped as a half vest similar to the left side of the outer front portion 22 of outer jacket 20, as previously shown in FIG. 4. The inner panel 90 has an arm hole 92, a right edge 94, and a left edge 96. The right edge 94 is preferably sewn into the outer back portion 24, as described previously for inner panel 90. In use, the arm hole 92 allows a person to fit the inner panel 90 comfortably around the torso. After having passed his or her left arm through the arm hole 92, the person may then stretch his or her left arm around the back of the second person. The left edge 96 of inner panel 90 is attached to the right front portion edge 23 of the outer jacket 20. Preferably a line of snaps are used on the left edge 96 to snap into matching snaps on the right front portion edge 23. In this embodiment is clearly shown another distinct advantage of the expandable garment 10. Referring back to FIG. 3 as well, two people can be even warmer and more comfortable by both being secured within their own jacket. However, when not desired to be worn, the inner panel 90 is simply tucked to be flat behind the inner jacket portion 50. In this "stored" position, no discomfort is felt nor is the inner panel 90 otherwise noticed by the two people. The inner panel 90 is lightweight in construction. yet suitable insulation materials are used to provide sufficient warmth as needed for a particular season, weather environment, or temperature experienced.

The expandable feature is certainly a novel advantage. The people wearing the expandable garment 10 in the expanded configuration can be not only different sizes physically, such as in girth, but of different heights as well. Not only can two or more family members enjoy wearing the expandable garment 10 simultaneously, but caring friends as well. The sufficient additional material in the expanded back portion 80 allows flexibility of movement by the wearers. They can easily embrace as they enjoy close physical contact. The expandable garment 10 can be worn at outdoor events, as well as indoors, depending on the temperature of the environment and comfort level of the people.

Many other features may be added to the present invention. The possible changes mentioned hereinbelow are merely illustrative and not all-encompassing. For instance, the method of closure of the outer front portion 22 of the outer jacket 20 can be accomplished by snaps, hooks, a zipper, or other fasteners known to the art. In addition, a variety of pocket types and quantities, as well as locations, on the outer jacket 20 can be incorporated into the present invention. For that matter, the inner jacket portion 50 can be fabricated to include pockets. Furthermore, all three sleeves can be made removable by the addition of a fastener, such as a zipper, around the arm holes and connected by suitable means to one or more of the three sleeves. The sleeves include the outer left sleeve 26, the outer right sleeve 28, and the inner sleeve 60.

The expandable garment 10 may be made of any appropriate material. Possible fabric materials include cotton, nylon, or other natural or synthetic materials, used alone, or in combination with others. Insulation materials to provide warmth also can vary. A multitude of different colors and patterns can also be incorporated into the design and fabrication of the expandable garment 10.

The present invention can be worn by people of all ages to a variety of events. People can enjoy wearing the expandable garment 10 to many events, particularly outdoors, such as walks, sporting events, concerts, and campfires.

It an now be seen that the present invention provides a unique, flexible, and convertible expandable outerwear garment that may be readily adapted for, and worn simultaneously by, different-sized people.

The foregoing description of the invention is explanatory thereof and various changes in the size, shape, and materials, as well as on the details of illustrated fabrication may be made, within the scope of the appended claims, without departing from the spirit of the invention.

What is claimed is:

1. A garment which comprises:

an outer jacket having an outer front portion, an outer back portion, and a pair of sleeves extending from said outer jacket, said outer back portion further comprises an expanded back portion of additional material, said expanded back portion securable to said outer back portion by suitable securing means;

an inner jacket portion having an inner front portion, an inner back lining portion, and an inner sleeve extending from said inner jacket portion; and connecting means between said outer jacket and said inner jacket portion, and wherein said suitable securing means further comprises a lower pile member secured in a vertically oriented position on said expanded back portion, an upper pile member secured in a vertically oriented position on said expanded back portion, a first loop member secured in a vertically oriented position on said expanded back portion, and a second loop member secured in a diagonally oriented position on said expanded back portion.

2. An outer garment comprising:

an outer jacket having a bodice with a front portion, a back portion, and a pair of sleeves;

an expanded back portion formed in said bodice of said outer jacket; means formed in said outer jacket for releasably enclosing said expanded back portion;

an inner jacket attached in part to said outer jacket bodice; and a sleeve attached to said inner jacket and removably received within one of said outer jacket sleeves, wherein said means for releasably enclosing said expanded back portion comprise:

a pair of fasteners, one of said pair of fasteners attached to said back portion of said outer jacket at a first location, the other of said pair of fasteners attached to said back portion at a second location, laterally separate from said first location.

3. An outer garment as described in claim 2, wherein said pair of fasteners are loop and pile fasteners.

* * * * *